United States Patent [19]

Zugel

[11] 4,386,768

[45] Jun. 7, 1983

[54] SIGNATURE FEEDING AND STITCHING APPARATUS

[75] Inventor: Victor A. Zugel, Parma, Ohio

[73] Assignee: Harris Corporation, Melbourne, Fla.

[21] Appl. No.: 234,923

[22] Filed: Feb. 17, 1981

[51] Int. Cl.[3] ..... B42B 2/00

[52] U.S. Cl. ..... 270/53; 198/644

[58] Field of Search ..... 270/37, 53; 112/21-22; 198/644; 271/250; 83/268, 925A

[56] References Cited

U.S. PATENT DOCUMENTS

| | | | |
|---|---|---|---|
| Re. 25,870 | 10/1965 | McCain . | |
| 937,925 | 10/1909 | Christensen . | |
| 1,206,227 | 11/1916 | Kast | 270/53 X |
| 3,090,481 | 5/1963 | Biel et al. . | |
| 3,366,225 | 1/1968 | Thorp . | |
| 3,554,531 | 1/1971 | Heigl et al. . | |
| 3,721,330 | 3/1973 | Crawford et al. . | |
| 3,722,336 | 3/1973 | Sarring | 83/925 A X |
| 3,811,350 | 5/1974 | Marciniak . | |

OTHER PUBLICATIONS

Publication by Warner Electric Brake & Clutch Company, Beloit, Wis.

*Primary Examiner*—A. J. Heinz

*Attorney, Agent, or Firm*—Yount & Tarolli

[57] ABSTRACT

An improved machine moves signatures to a work station, stitches the signatures and then moves the signatures away from the work station. The machine includes a conveyor belt assembly having upper and lower belts which grip a signature. The signature is gripped between a lower run of the upper belt and an upper run of the lower belt. When the signature has been moved to the work station, at least central portions of the lower run of the upper belt and the upper run of the lower belt are separated to release the signature. The released signature is accurately positioned relative to a stitcher mechanism by a register assembly which moves the signature relative to the separated upper and lower belts. Once the signature has been stitched, the lower run of the upper belt and the upper run of the lower belt are closed to grip the stitched signature and move it away from the work station. In order to promote accurate positioning of the signature relative to the stitcher mechanism, the upper and lower belts are not driven when they are separated. However, it is contemplated that the upper and lower belts could, if desired, be continuously driven.

4 Claims, 9 Drawing Figures

SIGNATURE FEEDING AND STITCHING APPARATUS

BACKGROUND OF THE INVENTION

This invention relates to a new and improved method and apparatus for moving a signature to a work station, stitching the signature at the work station and moving the stitched signature away from the work station.

A known machine uses a shuttle assembly to move a signature to a stitching station. As soon as the signature is released by the shuttle assembly at the stitching station, the direction of movement of the shuttle assembly is reversed and the shuttle assembly returns to grip the next succeeding signature. After the first signature has been stitched, the next signature is moved to the stitching station by the shuttle assembly. One known machine having this general construction is shown in U.S. Pat. No. 3,554,531.

Although machines of this type have been satisfactory in their operation, difficulty has been encountered in designing and manufacturing a relatively inexpensive machine which is capable of operating satisfactorily at high speeds. Part of this difficulty is due to the relatively large operating forces to which the numerous parts of the shuttle assembly are subjected during high speed reversal of the direction of shuttle movement. Thus each time a signature is moved to the stitching station, the shuttle assembly is moved through a forward stroke, quickly stopped, opened, rapidly moved through a reverse stroke of the same length as the forward stroke and then closed on a next succeeding signature.

Almost half of the operating time of the shuttle assembly is wasted in that it is spent in returning the shuttle assembly from an end of stroke position to a beginning of stroke position. During this return stroke, the shuttle assembly does not do any useful work. However, during the return stroke the numerous components of the shuttle assembly are subjected to wear inducing forces, particularly during rapid acceleration and deceleration of the shuttle assembly.

SUMMARY OF THE PRESENT INVENTION

The present invention provides a signature handling method and apparatus which does not utilize a shuttle assembly. In accordance with the present invention, a pair of belt assemblies are used to transport the signature to and from the stitching station. The direction of operation of the belt assemblies is not reversed to eliminate the wasted effort and component wear associated with return strokes of shuttle assemblies.

During operation of a machine constructed in accordance with the present invention, a signature is gripped between upper and lower conveyor belts and is moved to a stitching station. When the signature has been delivered to the stitching station, at least the central portions of the lower run of the upper conveyor belt and the upper run of the lower conveyor belt are separated and the signature is stitched. During the time when the signature is stitched, the conveyor belts are stationary. Once the signature has been stitched, the conveyor belts grip the signature and move it away from the stitching station.

It is contemplated that the signature may not be precisely located at the stitching station by the conveyor belts. Therefore, a register assembly is advantageously provided to move the signature relative to the conveyor belts after the signature has been moved to the stitching station and the conveyor belts have been separated. It is also contemplated that under certain circumstances it may be desirable to operate the machine without stopping the signature at the stitching station. Therefore, the conveyor belt drive assembly is operable either to intermittently drive the conveyor belts or to continuously drive the conveyor belts to move signatures through the stitching station without stopping.

Accordingly, it is an object of this invention to provide a new and improved method and apparatus for moving a signature to a work station, stitching the signature at the work station and moving the signature away from the work station and wherein upper and lower conveyor belts grip a signature to move it to and from the work station.

Another object of this invention is to provide a new and improved apparatus as set forth in the preceding object and wherein at least portions of a lower run of an upper conveyor belt and an upper run of a lower conveyor belt are separable to release a signature for movement by a register assembly.

BRIEF DESCRIPTION OF THE DRAWINGS

The foregoing and other objects and features of the present invention will become more apparent upon a consideration of the following description taken in connection with the accompanying drawings wherein.

DESCRIPTION OF SPECIFIC PREFERRED EMBODIMENTS OF THE INVENTION

Machine—General

Figure 1:
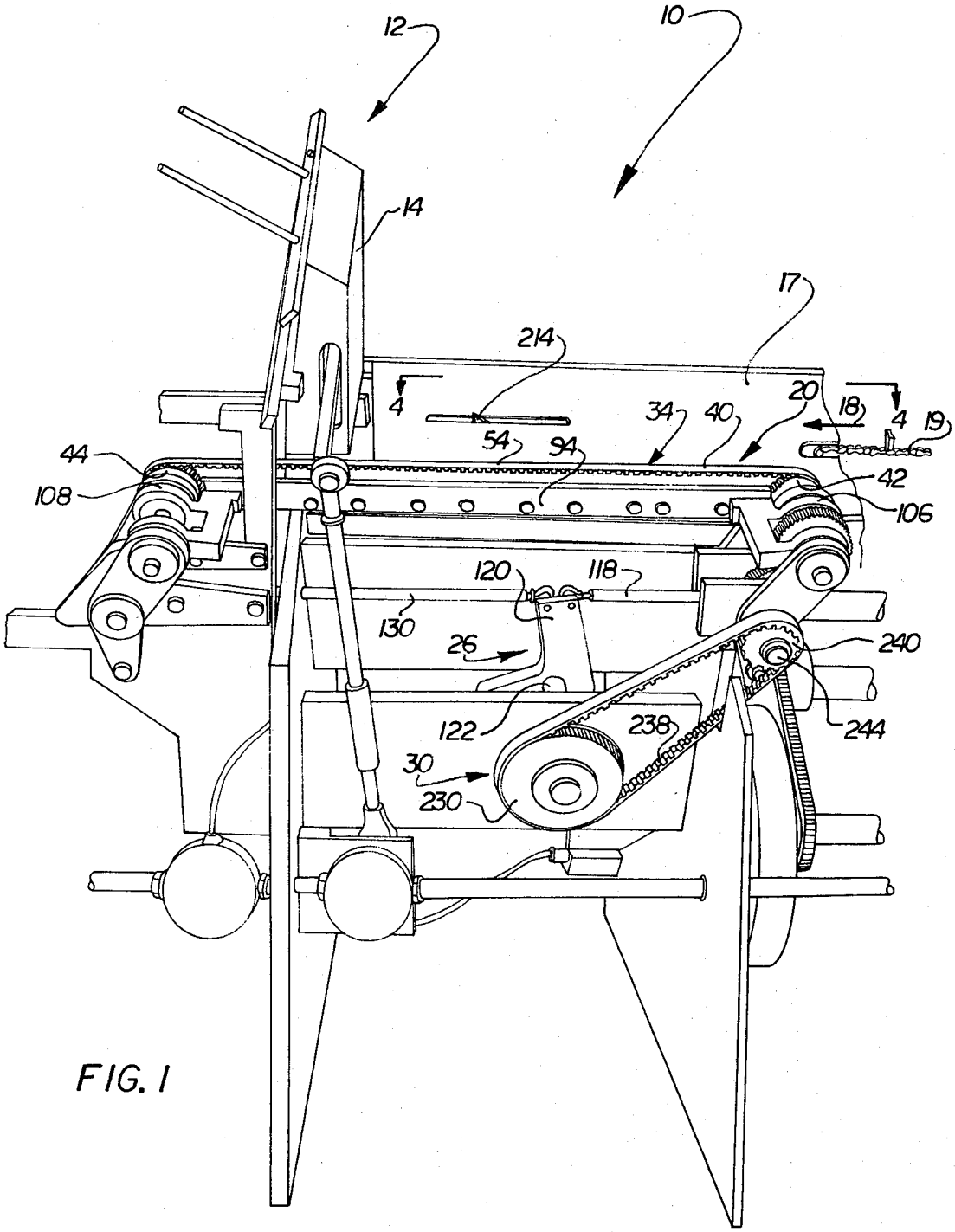
FIG. 1 is a fragmentary illustration of a machine constructed and operated in accordance with the present invention to move a signature to a work station, stitch the signature at the work station and move the signature away from the work station.

A machine 10 (FIG. 1) constructed and operated in accordance with the present invention, is operable to move signatures to a work station 12 where they are stitched or stapled by a known stitcher mechanism 14. During operation of the machine 10, the signatures are sequentially transported along a flat support surface 17 in the direction of the arrow 18 by a chain conveyor 19 of known construction. The chain conveyor 19 sequentially delivers the signatures to a conveyor belt assembly 20 which transports them through the work station 12 in the direction of the arrow 18. The infeed conveyor chain 19 moves signatures along the sloping support surface 17 from a collator to the conveyor belt assembly 20 in a known manner generally similar to that disclosed in U.S. Pat. No. 3,466,026.

The leading edge of a signature is engaged by the conveyor belt assembly 20 at a location on the right (as viewed in FIG. 1) side of the work station 12. As the signature is gripped by the conveyor belt assembly 20, the signature is accelerated and moved away from the conveyor chain 19 toward the stitcher mechanism 14 at a relatively high speed. Once the signature has been moved to a position beneath the stitcher mechanism 14, the conveyor belt assembly 20 releases the signature so that it can be moved relative to the conveyor belt assembly.

Once the signature has been released by the conveyor belt assembly 20, a register assembly 22 (FIG. 2) engages the trailing edge portion of the signature and accurately positions it relative to the stitcher assembly 14. The stitcher assembly 14 is then actuated to stitch or staple the signature while it is accurately located relative to the stitcher assembly. After the signature has been stitched, the conveyor belt assembly 20 again grips the signature and moves it away from the work station 12.

It is contemplated that the signature will be transported from the work station 12 to a folder-trimmer assembly (not shown) where the stitched signature is folded. A knife (not shown) trims the edges of the folded signature. Although many different types of folder-trimmer assemblies could be used, a folder-trimmer assembly similar to the one shown in U.S. Pat. No. 3,627,305 is particularly advantageous.

Figure 2:
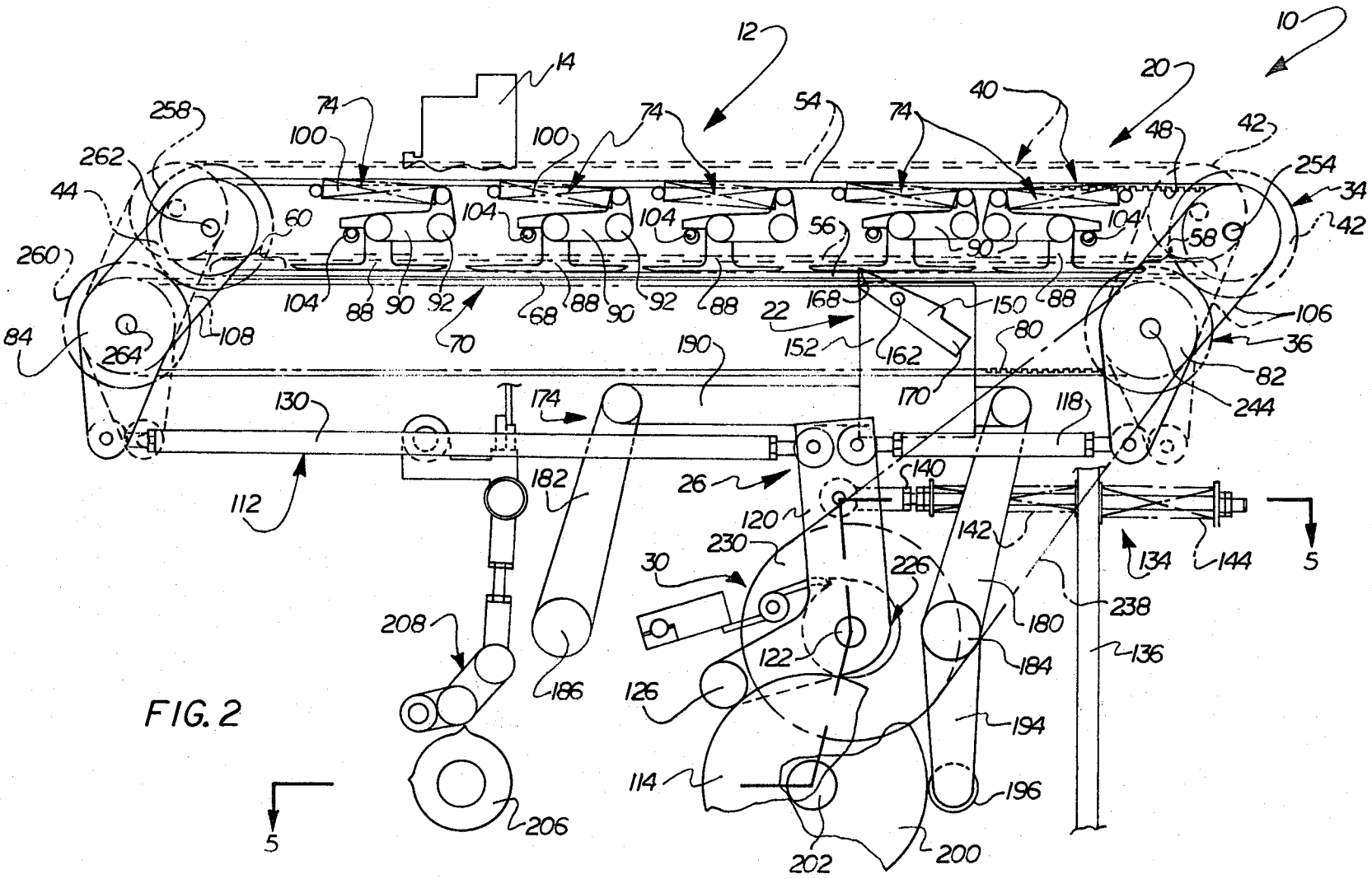
FIG. 2 is a schematic illustration of a portion of the machine of FIG. 1 and depicting the relationship between upper and lower conveyor belts, an actuator assembly for effecting operation of the conveyor belts between an engaged condition gripping a signature and a disengaged condition in which the signature is movable relative to the conveyor belts, and a register assembly for moving the signature relative to the conveyor belts.

To enable a signature gripped by the conveyor belt assembly 20 to be released at the work station 12, stitched, and again gripped by the conveyor belt assembly, the conveyor belt assembly is operated between an engaged condition and a disengaged condition by an actuator assembly 26 (sse FIG. 2). When the conveyor belt assembly 20 is in the engaged condition, it is driven by a belt drive assembly 30 to move a gripped signature to and from the work station 12. When the conveyor belt assembly 20 is in the disengaged condition, the conveyor belt assembly is ineffective to grip the signature so that it can be registered and stitched at the stitching station 12.

It is preferred to interrupt operation of the conveyor belt assembly 20 when the signature is being stitched to thereby facilitate settling of the signature at the stitching station 12. However, it is contemplated that under certain circumstances it may be desirable to move signatures through the stitching station 12 without stitching the signatures. Under these conditions, the belt drive assembly 30 effects continuous operation of the conveyor belt assembly 20 to move signatures through the stitching station without stopping.

CONVEYOR BELT ASSEMBLY

The conveyor belt assembly 20 includes an upper belt assembly 34 and a lower belt assembly 36 (FIG. 2). The upper belt assembly 34 includes a flexible continuous conveyor belt 40 which extends around drive pulleys 42 and 44 disposed on opposite sides of the stitching station 12. The continuous conveyor belt 40 has internal teeth 48 (see FIG. 3) which engage external teeth on the pulleys 42 and 44. Thus, the pulley 42 is provided with external teeth 50 which are engaged by the belt teeth 48 to provide a positive drive between the belt and the pulley 42. The opposite pulley 44 is provided with external teeth similar to the teeth 50 on the pulley 42.

The continuous upper conveyor belt 40 has straight upper and lower runs 54 and 56 (FIG. 2) which extend through the work station 12 and extend tangentially to the two pulleys 42 and 44. The lower run 56 of the upper conveyor belt 40 has an inlet portion 58 which partially defines a nip between the upper and lower conveyor belt assemblies 34 and 36. Signatures are initially gripped between the two conveyor belt assemblies 34 and 36 at the inlet 58. The lower run 56 of the upper conveyor belt 40 has an outlet portion 60 on the opposite or outlet side of the work station 12. The stitched signatures are discharged from the conveyor belt assembly as they pass through the outlet portion 60.

Figure 3:
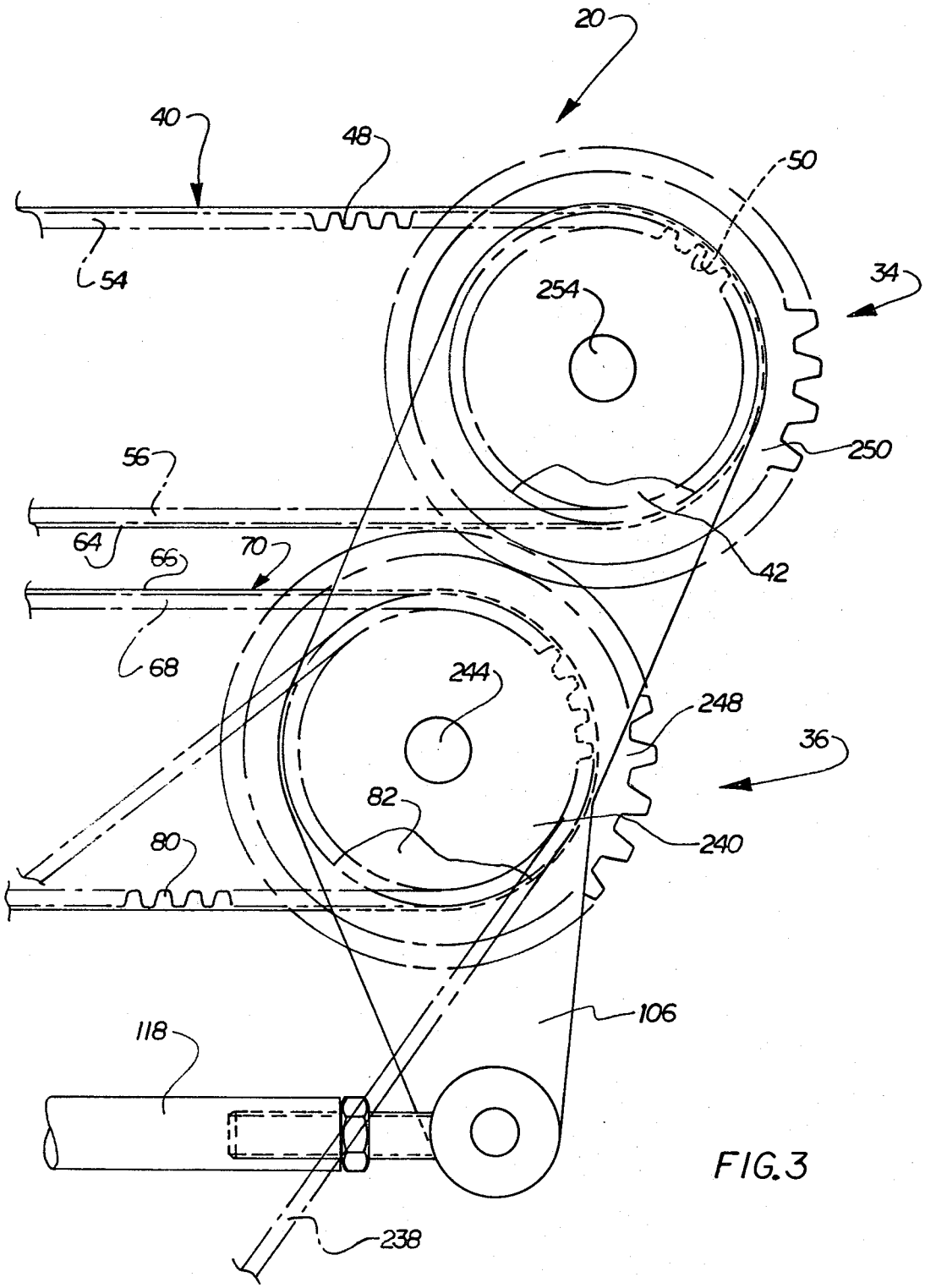
FIG. 3 is an enlarged fragmentary schematic illustration depicting the relationship between the upper and lower conveyor belts of FIG. 2 when they are in the disengaged condition.

The central portion of the lower run 56 of the conveyor belt 40 extends between the inlet and outlet portions 58 and 60 and forms the majority of the length of the lower run 56 of the conveyor belt 40. The central portion of the lower run 56 of the conveyor belt 40 has a flat side surface 64 (FIG. 3). The belt surface 64 is pressed into tight abutting engagement with a flat upper side surface 66 (FIG. 3) of an upper run 68 of a lower conveyor belt 70 when the conveyor belt assembly 20 is in the engaged condition shown in solid lines in FIG. 2.

Upon operation of the conveyor belt assembly 20 to the disengaged condition shown in dashed lines in FIG. 2, the lower side surface 64 of the lower run 56 of the conveyor belt 40 is spaced from the upper side surface 66 of the upper run 68 of the lower conveyor belt 70 (see FIG. 3). When the conveyor belt assembly 20 is in the engaged condition shown in solid lines in FIG. 2 and a signature is not present, the lower run 56 of the upper conveyor belt 40 is pressed firmly against the upper run of the lower conveyor belt 70 by a plurality of biasing assemblies 74.

The upper run 68 of the lower conveyor belt 70 has an inlet portion which is disposed opposite to and engaged by the inlet portion 58 of the lower run of the upper conveyor belt 40 when the conveyor belt assembly 20 is in the engaged condition. In addition, the upper run 68 of the lower belt 70 has an outlet portion which is disposed in engagement with the outlet portion 60 of the lower run 56 of the upper conveyor belt 40 when the conveyor belt assembly 20 is in the engaged condition.

The upper run 68 of the lower conveyor belt 70 also has a central portion which extends between the inlet and outlet portions of the upper run of the lower conveyor belt. The central portion of the upper run of the lower conveyor belt is engaged by the central portion of the lower run 56 of the upper conveyor belt 40 when the conveyor belt assembly 20 is in the engaged condition. The conveyor belts 40 and 70 can be of any desired length which is compatible with the machine 10 and is sufficient to enable them to extend through the work station 12.

Due to the influence of the biasing assemblies 74, the flat side surfaces of the lower run 56 of the upper conveyor belt 40 and the upper run 68 of the lower conveyor belt 70 cooperate to firmly grip a signature and hold it against movement relative to the conveyor belt assembly 20 when the conveyor assembly is in the engaged condition. However, when the conveyor belt assembly 20 is in the disengaged condition illustrated in dashed lines in FIG. 2 and solid lines in FIG. 3, the lower run 56 of the upper conveyor belt is separated from the upper run 68 of the lower conveyor belt 70 so that a signature is free to move relative to the conveyor belt assembly 20.

The construction of the lower conveyor belt 70 is generally the same as the construction of the upper conveyor belt 40. Thus, the lower conveyor belt 70 has internal teeth 80 which engage external teeth on a pair of pulleys 82 and 84 (see FIGS. 2 and 3). The use of toothed conveyor belts 40 and 70 retards slippage of the conveyor belts relative to the drive pulleys 42, 44, 82 and 84 to promote accurate positioning of a signature relative to the stitcher mechanism 14 by the conveyor belt assembly 20. However, if desired, conveyor belts having other known constructions could be used.

Figure 4:
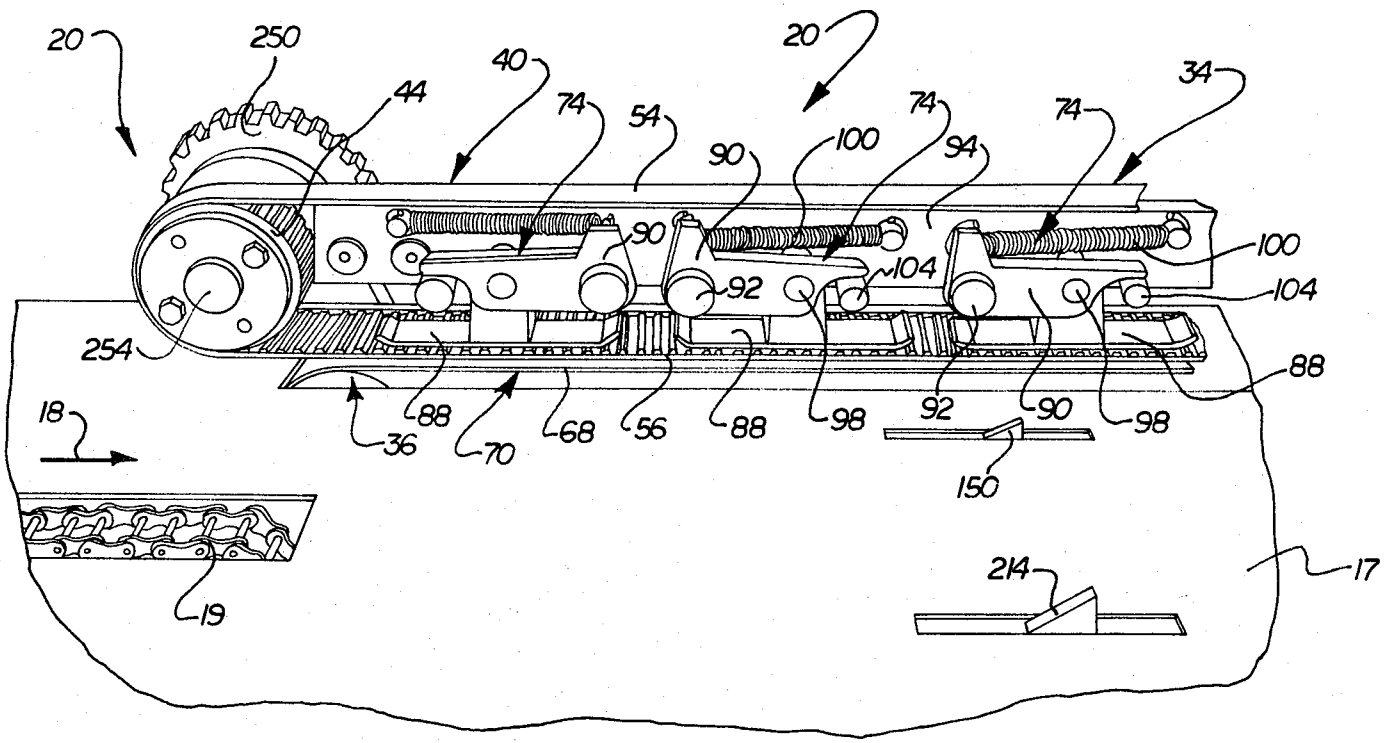
FIG. 4 is a fragmentary pictorial illustration, taken generally along the line 4—4 of FIG. 1, depicting the relationship between the upper and lower conveyor belts and a pair of register fingers.

Each of the biasing assemblies 74 includes a shoe 88 which is pressed downwardly against an upper side surface of the lower run 56 of the upper conveyor belt 40 (see FIG. 4). Each shoe 88 is connected to a crank arm 90. Each crank arm 90 is pivotally mounted on a support pin 92 (FIG. 4) which is connected with a support bar 94 disposed between the upper and lower runs 54 and 56 of the upper conveyor belt 40. One end portion of the crank arm 90 is connected with the shoe 88 at a pivot connection 98. The opposite end portion of the crank arm 90 is connected with a biasing spring 100.

The biasing spring 100 is effective to urge the shoe 88 downwardly against the lower run 56 of the upper conveyor belt 40 to press it firmly against the upper run 68 of the lower conveyor belt 70. An eccentric stop 104 is provided to limit the extent of downward movement of the shoe 88. Thus, when the conveyor belt assembly 20 is in the disengaged condition shown in dashed lines in FIG. 2, the crank arms 90 engage the stops 104 to limit the extent to which the shoes 88 are pressed downwardly. However when the conveyor belt assembly 20 is in the engaged condition, the crank arms 90 are separated from the stops 104 and downward movement of the shoes 88 is limited by the lower run 56 of the upper conveyor belt 40.

Actuator Assembly

The conveyor belt assembly 20 is operated from the engaged condition shown in solid lines in FIG. 2 to the disengaged condition shown in dashed lines in FIG. 2 by the actuator assembly 26. When the conveyor belt assembly 20 is to be operated from the engaged condition shown in solid lines in FIG. 2 to the disengaged condition, the actuator assembly 26 is operable to move the lower run 56 of the upper conveyor belt 40 upwardly away from the upper run 68 of the lower conveyor belt 70. This establishes a space between the upper and lower runs of the two conveyor belts. When the conveyor belt assembly 20 is in the disengaged condition, the registration assembly 22 can move the signature in the space between the upper run 68 of the lower conveyor belt 70 and the lower run 56 of the upper conveyor belt 40.

It is contemplated that the lower run 56 of the upper conveyor belt 40 could be separated from the upper run 68 of the lower conveyor belt 70 in many different ways. In the illustrated embodiment of the invention the entire upper belt assembly 34 is moved upwardly away from the lower belt assembly 36 to effect operation of the conveyor belt assembly 20 to the disengaged condition. However if desired, suitable lift elements could be provided to raise only the central portion of the lower run 56 of the conveyor belt 40. In addition, it is contemplated that the upper run 68 of the lower conveyor belt 70 could be lowered if desired.

To effect operation of the conveyor belt assembly 20 from the engaged condition shown in solid lines in FIG. 2 to the disengaged condition shown in dashed lines, the entire upper belt assembly 34 is moved upwardly away from the lower belt assembly 36. To this end, the pulleys 42 and 44 of the upper belt assembly 34 are mounted for pivotal movement relative to the pulleys 82 and 84 of the lower belt assembly 36. This allows the upper pulleys 42 and 44 to be pivoted in a counterclockwise direction (as viewed in FIG. 2) from the position shown in solid lines to the position shown in dashed lines. As the upper pulleys 42 and 44 are moved upwardly and leftwardly from the engaged position to the disengaged position, the lower run 56 of the upper conveyor belt 40 moves upwardly away from the upper run 68 of the lower conveyor belt 70.

To provide for movement of the upper pulleys 42 and 44 relative to the lower pulleys 82 and 84, the upper pulleys are mounted on support arms 106 and 108 (FIG. 2) which pivot about the centers of rotation of the lower pulleys 82 and 84. When the conveyor belt assembly 20 is to be operated from the engaged condition to the disengaged condition, the pulley support arms 106 and 108 are rotated in a counterclockwise direction (as viewed in FIG. 2) about the central axes of the lower pulleys 82 and 84. This pivots the upper pulleys 42 and 44 upwardly and leftwardly to separate the lower run of the upper conveyor belt 40 and the upper run of the lower conveyor belt 68 in the manner shown in FIG. 3.

The actuator assembly 26 includes a linkage 112 (FIG. 2) which interconnects the pulley support arms 106 and 108. The linkage 112 is actuated by a cam 114 to pivot the pulley support arms 106 and 108 between the engaged position shown in solid lines in FIG. 2 and the disengaged position shown in dashed lines. The cam 114 is fixedly connected with a drive shaft 202.

The actuator linkage 112 includes a link 118 which connects the pulley support arm 106 with a crank arm 120. The crank arm 120 is pivotally mounted on a shaft 122 (see FIGS. 2 and 5). The crank arm 120 has a follower 126 which is disposed in engagement with the cam 114. The crank arm 120 is connected with the pulley support arm 108 by a second link 130.

Upon rotation of the cam 114, the crank arm 120 (FIG. 2) is pivoted about the shaft 122 to move the links 118 and 130 to pivot the pulley support arms 106 and 108. Thus when the pulley support arms 106 and 108 are to be pivoted from the engaged position shown in solid lines in FIG. 2 to the disengaged position shown in dashed lines in FIG. 2, the cam 114 pivots the crank arm 120 in a clockwise direction (as viewed in FIG. 2). This shifts the actuator links 118 and 130 toward the right as viewed in FIG. 2. The pulley support arms 106 and 108 are rotated in a counterclockwise direction about the central axes of the lower pulleys 82 and 84 to raise the upper belt assembly 34 to the disengaged position.

Similarly, when the upper belt assembly 34 is to be moved from the disengaged position to the engaged position, the cam 114 cooperates with a cam follower 126 to effect pivotal movement of the crank arm 120 in a counterclockwise direction about the shaft 122. This moves the pulley support arms 106 and 108 in a clockwise direction to lower the upper belt assembly 34.

The follower 126 is maintained in abutting engagement with the cam 114 by a biasing spring assembly 134 which is connected with a frame member 136. The biasing assembly 134 includes a spring rod 140 which is connected to the crank arm 120. A biasing spring 142 cooperates with the spring rod 140 to hold the cam follower 126 in firm abutting engagement with the outside surface of the cam 114.

Register Assembly

The register assembly 22 moves a signature to a desired position relative to the stitcher assembly 14 when the conveyor belt assembly 20 is in the disengaged condition shown in dashed lines in FIG. 2. The register assembly 22 includes a register finger 150 (see FIGS. 2 and 6) which is pivotally mounted on a carrier block 152. The register finger 150 moves a signature through a short distance toward the stitcher mechanism 14 when the conveyor belt assembly 20 is disengaged to accurately locate the signature for stitching.

Figure 6:
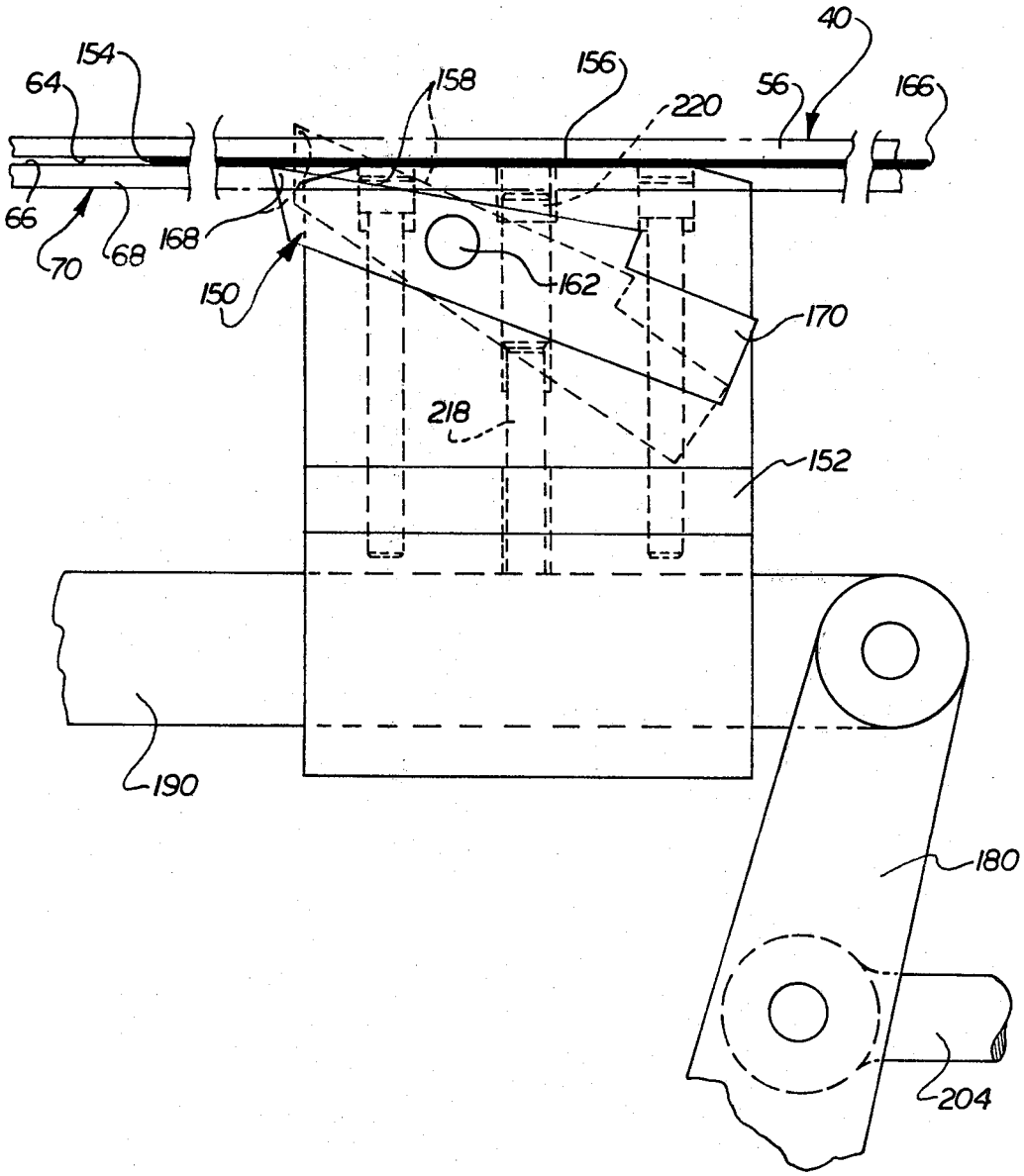
FIG. 6 is an enlarged schematic of a portion of the register assembly of FIG. 2 and illustrating the relationship between a register finger and a signature.

As a signature is moved toward the work station 12 by the conveyor belt assembly 20 with the belts in the engaged condition shown in FIG. 6, a leading edge portion 154 (FIG. 6) of a signature 156 engages a back edge 158 of the register finger 150. The force applied by the leading edge 154 of the signature against the back surface 158 of the register finger 150 pivots the register finger in a counterclockwise direction about a support 162. This results in movement of the register finger from the extended position shown in dashed lines in FIG. 6 to the retracted position shown in solid lines.

As the signature 156 is moved further into the work station 12 by the conveyor belt assembly 20, a trailing edge 166 of the signature moves past a nose or upper end portion 168 of the register finger 150. As this occurs, a relatively heavy tail end portion 170 of the register finger causes it to pivot in a clockwise direction (as viewed in FIG. 6) about the support pin 162. As this occurs, the register finger moves from the retracted position shown in solid lines in FIG. 6 to the extended position shown in dashed lines. Once the trailing edge 166 of the signature 156 has been moved past the nose 168 of the register finger 150, the conveyor belt assembly 20 is operated to the disengaged condition so that the conveyor belts 40 and 70 do not grip the signature.

Once the conveyor belt assembly 20 has been operated to the disengaged condition, a register finger drive assembly 174 (FIG. 2) is operable to move the register finger 150 forwardly toward the stitcher mechanism 14. As the register finger 150 moves forwardly, the extended nose end portion 168 (FIG. 6) of the register finger engages the trailing edge 166 of the signature. Continued forward movement of the register finger 150 pushes the signature 156 along the support surface 17 toward the stitcher mechanism 14.

When the signature 156 has been moved to a predetermined position relative to the stitcher mechanism 14 by the register finger 150, the stitcher mechanism 14 stitches the signature. Once the signature has been stitched, the conveyor belt assembly 20 is operated from the disengaged condition to the engaged condition to again grip the signature. The register finger 150 is then moved rearwardly away from the stitcher mechanism 14.

The register finger 150 is moved forwardly toward the stitcher mechanism 14 to accurately register a signature and is moved rearwardly away from the stitcher mechanism 14 when the signature has been stitched by the register finger drive assembly 174 (FIG. 2). The register finger drive assembly 174 includes a pair of pivot arms 180 and 182 which are pivotal about support pins 184 and 186 (see FIG. 2). The pivot arms 180 and 182 are interconnected by a support bar 190 upon which the register finger carrier block 152 is mounted.

The pivot arm 180 has a downwardly extending end portion 194 upon which a cam follower 196 is mounted. The cam follower 196 is disposed in abutting engagement with a cam 200 fixedly mounted on a rotatable shaft 202 in a coaxial relationship with the actuator cam 114 (see FIGS. 2 and 5). A biasing spring assembly (not shown) is connected with the pivot arm 194 by a rod 204 (see FIG. 5) in much the same manner as in which the biasing spring assembly is connected with the crank arm 120 in the actuator linkage 112 (see FIG. 2).

In order to register a signature relative to the stitcher mechanism 14 after the trailing edge 166 of the signature has moved past the register finger 150, the cam 200 pivots the support arms 180 and 182 in a counterclockwise direction (as viewed in FIG. 2) about the support pins 184 and 186. This moves the register finger 150 toward the stitcher mechanism 14. Since the conveyor belt assembly is in the disengaged position, the register finger 150 moves the signature 156 relative to the conveyor belts toward the stitcher mechanism 14 until the signature is in a predetermined position relative to the stitcher mechanism.

Once the signature 156 has been moved to a predetermined position relative to the stitcher mechanism 14, a cam 206 (see FIGS. 2 and 5) actuates a stitcher linkage 208 (FIG. 2) to operate a stitcher clincher mechanism to stitch the signature. The construction and mode of operation of the stitcher mechanism 14 is well known and will not be further described herein.

Once the signature has been stitched, the cam 200 cooperates with a cam follower 196 to effect pivotal movement of the arms 180 and 182 in a clockwise direction about the support pins 184 and 186 to move the register finger 150 away from the stitcher mechanism 14 back to its initial position. The conveyor belt assembly 20 is then operated from the disengaged condition to the engaged condition to grip the stitched signature. The conveyor belt assembly then moves the stitched signature away from the stitcher mechanism 14 and discharges the stitched signature from the work station 12.

It is contemplated that the stitched signature will be conducted from the work station 12 to a suitable folder and trimmer assembly where the signature will be trimmed and/or folded in a known manner. Although the folder and trimmer assembly has not been shown in the drawings, it is contemplated that it will be constructed in a manner similar to that disclosed in U.S. Pat. No. 3,627,305. However, it is also contemplated that different folder and trimmer mechanisms could be used if desired.

Although only a single register finger 150 has been shown in FIGS. 2 and 6, a pair of register fingers are connected with the support bar 190. Thus, the trailing edge 166 of the signature 156 is engaged by the register finger 150 and by a second register finger 214 (see FIG. 4). By using a pair of register fingers 150 and 214 to engage the trailing edge 166 of a signature, the signature is accurately aligned along an axis extending perpendicular to the path of movement of the conveyor belts 40 and 70 as the signature is registered relative to the stitcher mechanism 14.

It is contemplated that the machine 10 will be used in association with signatures of many different sizes and in association with signatures which are to be either center stitched or stitched along an edge portion. Therefore, the register fingers 150 and 214 are movable along the support bar 190 to enable signatures to be registered at different locations relative to the stitcher mechanism 14. To this end, the register finger carrier 152, to which both of the register fingers 150 and 214 are connected, is held in engagement with the support bar 190 by a pin 218 (FIG. 6) which is pressed against the support bar by a set screw 220. By releasing the set screw 220, the carrier 152 can be moved along the support bar 190 to locate the register fingers 150 and 214 relative to the stitcher mechanism 14 to accommodate signatures of different sizes.

Conveyor Belt Drive

The upper belt assembly 34 and lower belt assembly 36 (see FIG. 2) are driven at the same speed by the conveyor belt drive assembly 30. The conveyor belt drive assembly 30 includes the drive shaft 122 which is driven through a clutch assembly 226. The conveyor belt drive assembly 30 also includes a relatively large main drive pulley 230 which is fixedly connected with the drive shaft 122. The crank arm 120 is supported on the drive shaft 122 by a pair of bearing assemblies 234 and 236 (FIG. 5) so that the drive shaft 122 is freely rotatable relative to the crank arm 120.

Drive forces are transmitted from the main drive pulley 230 to the belt drive pulley 82 on the lower belt assembly 36 by an internally toothed drive belt 238. The drive belt 238 engages an externally toothed drive pulley 240 (see FIGS. 1 and 3) which is disposed in a coaxial relationship with the lower conveyor belt drive pulley 82 and is fixedly connected with a drive shaft 244 to which the lower conveyor belt drive pulley 82 is also connected. Therefore, rotation of the main drive pulley 230 (FIG. 1) is effective to rotate the drive pulley 240 and the lower conveyor belt drive pulley 82 (FIGS. 2 and 3). The drive forces are transmitted by the lower conveyor belt 70 to the opposite conveyor belt pulley 84 (see FIG. 2).

A pair of meshing spur gears 248 and 250 (FIG. 3) transmit drive forces from the lower conveyor belt assembly 36 to the upper conveyor belt assembly 34. The gear 248 is fixedly connected to the drive shaft 244 along with the input drive gear 240 from the main drive belt 238 and the lower conveyor belt drive pulley 82. Therefore, the main drive gear 248 is rotated at the same speed as the lower conveyor belt pulley 82.

Since the upper drive gear 250 (FIG. 3) has the same diameter and number of teeth as the lower gear 248, the upper drive gear 250 is rotated at the same speed as the lower conveyor belt drive pulley 82. The upper drive gear 250 is connected with the upper conveyor belt drive pulley 42 by a shaft 254 to which both the gear 250 and upper conveyor belt drive pulley 42 are fixedly connected in a coaxial relationship. Therefore, the upper conveyor belt drive pulley 42 is driven at the same speed as the lower conveyor belt drive pulley 82 so that the upper conveyor belt 40 is driven at the same speed as the lower conveyor belt 70.

Although the drive gears 248 and 250 (FIG. 3) interlock the upper and lower belt assemblies 34 and 36 so that the conveyor belts 40 and 70 are driven at the same speeds, a pair of gears 258 and 260 (FIG. 2) are mounted on support shafts 262 and 264 which connect the drive gears with the pulleys 44 and 84. The drive gears 258 and 260 are disposed in a meshing relationship with each other in the same manner as are the gears 248 and 250 to further assure that the upper and lower conveyor belts 40 and 70 will be driven at the same speed. If desired, drive forces for coordinating operation of other equipment, such as a folder trimmer, could be transmitted from the drive gear 260.

The drive gears 250 and 258 for the upper belt assembly 34 are pivoted about the support shafts 244 and 264 upon operation of the conveyor belt assembly 20 between the engaged and disengaged conditions. However, the drive gears 248 and 250 are maintained in continuous meshing engagement as are the drive gears 258 and 260 so that the conveyor belts 40 and 70 are always moved at the same speed.

When the conveyor belt assembly 20 is in the disengaged condition, movement of the upper and lower conveyor belts 40 and 70 is interrupted to prevent a signature from being disturbed by the movement of the conveyor belts prior to stitching of the signature. The drive to the upper and lower conveyor belt assemblies is interrupted by disengagement of the clutch assembly 226. Thus, when the conveyor belts are being driven to move a signature either toward or away from the stitching station 12, drive forces are transmitted from an input sprocket 266 (FIG. 5) to the drive shaft 202. The drive shaft 202 is rotatably supported by bearing assemblies 268 and 270. A drive gear 274 is fixedly connected with the drive shaft 202 (see FIG. 5) and is disposed in meshing engagement with a clutch input gear 276. The drive forces from the gear 276 are transmitted through the clutch assembly 226 to the output shaft 122.

Figure 5:
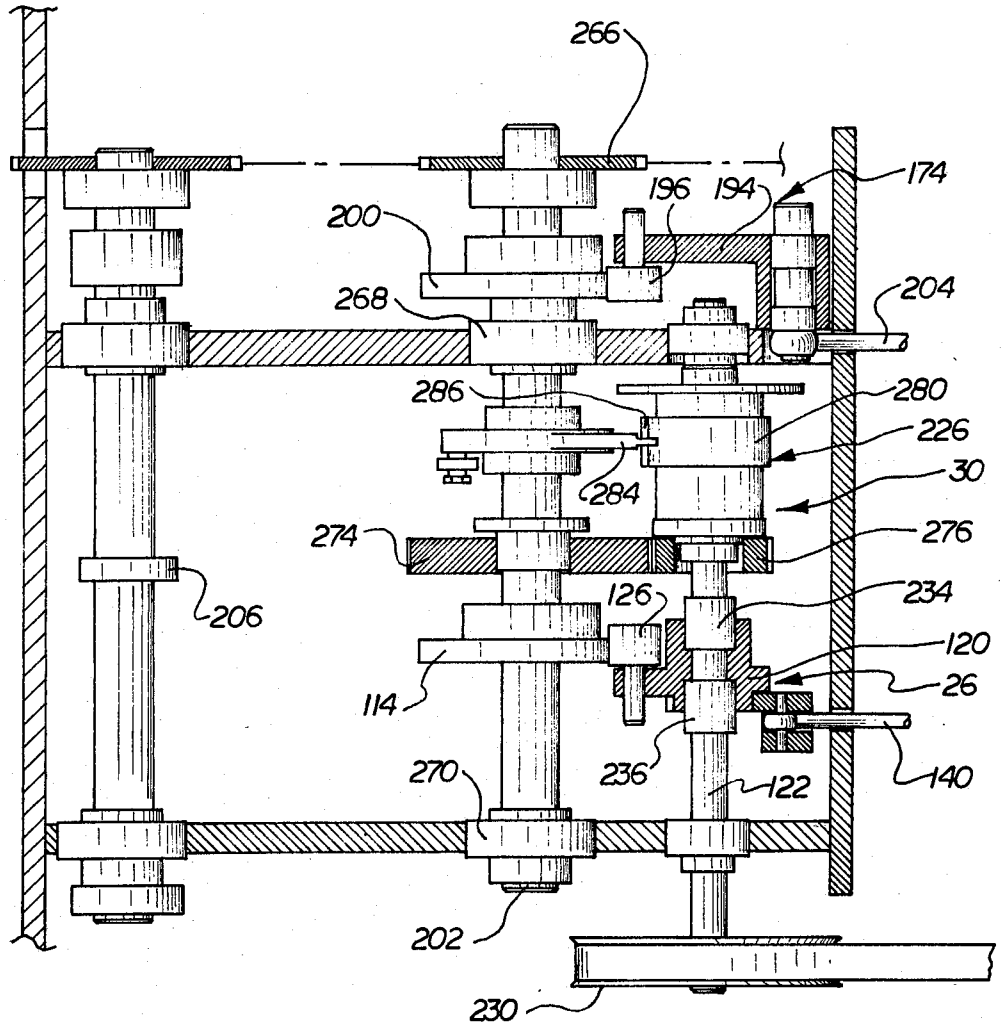
FIG. 5 is a fragmentary sectional view, taken generally along the line 5—5 of FIG. 2, illustrating the relationship between control cams and clutches for effecting operation of the conveyor belts to the disengaged condition, controlling movement of the register fingers, and controlling the transmission of drive forces to the conveyor belts.
Figure 7:
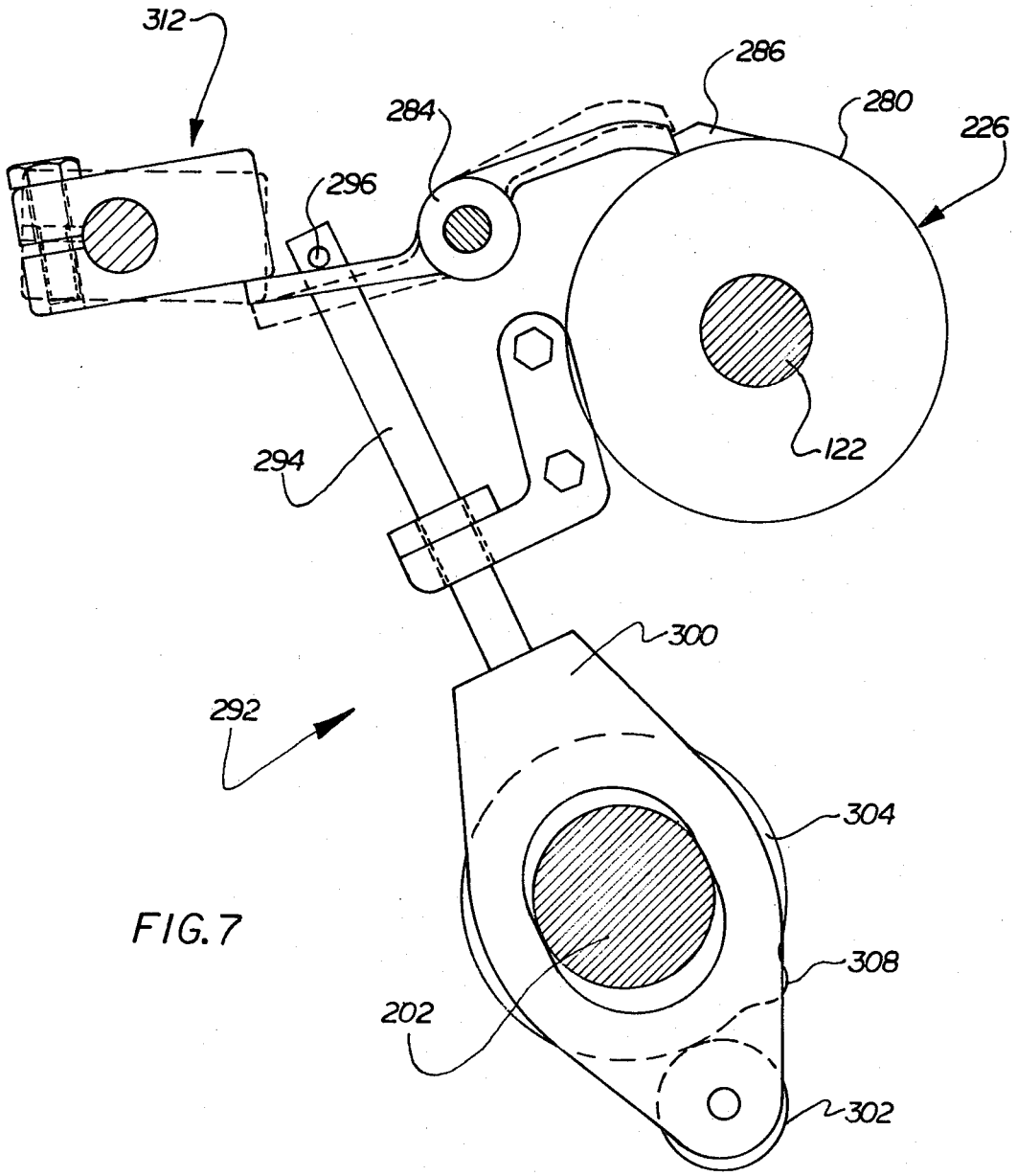
FIG. 7 is a fragmentary illustration depicting an apparatus for releasing and engaging a conveyor belt drive clutch.

The clutch assembly 226 is of the wrap spring type and is actuated by blocking rotation of a stop collar 280 (FIGS. 5 and 7). The clutch 226 is engaged when the collar 280 is free to rotate with the input gear 276 (FIG. 5). At this time, a wrap spring in the clutch 226 contracts to connect an input hub, which is fixedly secured with the gear 276, with an output hub, which is fixedly connected to the drive shaft 122. When the stop collar 280 is held against rotation with the input gear 276, the wrap spring expands and the input hub of the clutch assembly 226 is disconnected from the output hub of the clutch assembly to interrupt the transmission of drive forces through the clutch assembly.

In one specific embodiment of the invention, the wrap spring clutch 226 was a PSI series on-off clutch Model SS which is commercially available from The Warner Electric Brake & Clutch Company, of Beloit, Wis., USA. Of course, other known types of clutches could be used if desired.

When the drive through the clutch 226 (FIG. 7) is to be interrupted, a pawl 284 engages a stop projection 286 on the collar 280 to prevent the collar from rotating with the input gear 276 (see FIG. 5). This loosens the wrap spring in the clutch assembly 226. When the clutch assembly 226 is to be engaged, the pawl 264 is actuated from the solid line position to the dashed line position in FIG. 7 to release the stop collar 280 for rotational movement with the drive gear 276 (see FIG. 5).

The pawl 284 is actuated between the engaged and disengaged positions by a clutch actuator assembly 292 (see FIG. 7). The clutch actuator assembly 292 which includes an actuator rod 294 having an end projection 296 which engages one end of the pawl 284. The actuator rod 294 is connected with a bracket 300 upon which a cam follower 302 is mounted.

A cam 304 is fixedly connected to the shaft 202 and cooperates with the cam follower 302 to effect pivotal movement of the pawl 284 between the engaged and disengaged position. Thus the pawl 284 is urged, by a biasing spring (not shown), toward the disengaged position shown in solid lines in FIG. 7. At this time, the clutch assembly 226 is ineffective to transmit drive forces. When a nose lobe 308 on the cam 304 engages the cam follower 302, the actuator rod 224 is moved downwardly (as viewed in FIG. 7) to pivot the pawl 284 to the engaged or dashed line position shown in FIG. 7.

When the clutch 226 is engaged by raising the pawl 284, the pawl is spaced apart from the stop projection 286 on the actuator collar 280 so that the collar is free to rotate. This results in engagement of the clutch assembly 226 to transmit drive forces to the upper and lower conveyor belt assemblies 34 and 36.

The clutch assembly 226 is maintained in the disengaged condition until the cam lobe 308 actuates the cam follower bracket 300 to pull the actuator rod 244 downwardly. The clutch 226 is then engaged and the collar 280 rotates in a counterclockwise direction (as viewed in FIG. 7) with the shaft 122. As the collar 280 is rotating with the shaft 122, the cam lobe 308 moves out of engagement with the cam follower 302 so that the pawl 284 is released for downward movement to the position shown in solid lines in FIG. 7). Therefore, continued rotation of the stop collar 280 in a counterclockwise direction (as viewed in FIG. 7) will bring the projection 286 back into engagement with the pawl 284 after the shaft 122 has been rotated through one complete revolution. This results in rotation of the collar 280 being stopped and the clutch assembly 286 being actuated to the disengaged position.

In the illustrated embodiment of the invention, one half of an operating cycle is used to register and stitch a signature. Therefore, the clutch assembly 226 is engaged during half of an operating cycle and is disengaged during the other half of the operating cycle. An operating cycle of the machine 10 occurs every time the shaft 202 rotates through one complete revolution.

To provide for engagement of the clutch 226 during one half of an operating cycle and disengagement of the clutch during the other half of the operating cycle, the gear 274 (see FIG. 5) has a diameter which is twice as great as the clutch gear 276. Therefore, each time the drive shaft 202 moves through one complete revolution, the clutch input gear 276 is rotated through two complete revolutions. However, cam 304 is fixedly connected with the drive shaft 202 so that the pawl 284 is actuated to the engaged position shown in dashed lines in FIG. 7 once on each revolution of the shaft 202. This results in the clutch 226 being engaged for one half of each revolution of the shaft 202.

It is contemplated that under certain circumstances it will be desired to continuously operate the conveyor belt assembly 20 to move signatures through the work station 12. At this time, the actuator assembly 26 is disabled to prevent the conveyor belt assembly 20 from being operated between the engaged and disengaged conditions. To accomplish this, the clutch pawl 284 (FIG. 7) is held in the position shown in dashed lines in FIG. 7 so that the clutch assembly 226 is continuously engaged.

In order to hold the clutch pawl 284 in the raised or engaged position shown in dashed lines in FIG. 7, a lockout member 312 is rotated in a clockwise direction from the position shown in solid lines in FIG. 7 to the position shown in dashed lines in FIG. 7. This rotates the clutch pawl 284 in a counterclockwise direction. As long as the lockout member 312 is held in the position shown in dashed lines in FIG. 7, the clutch pawl is held up out of engagement with the stop 286 so that the clutch assembly 226 is effective to transmit drive forces to the conveyor belt assembly 20. It is contemplated that the machine 10 will be operating with the clutch continuously engaged when signatures are not to be stitched but merely to be transmitted through the stitching station 12 to the folder and trimmer assembly.

Operating Cycle

Figure 8:
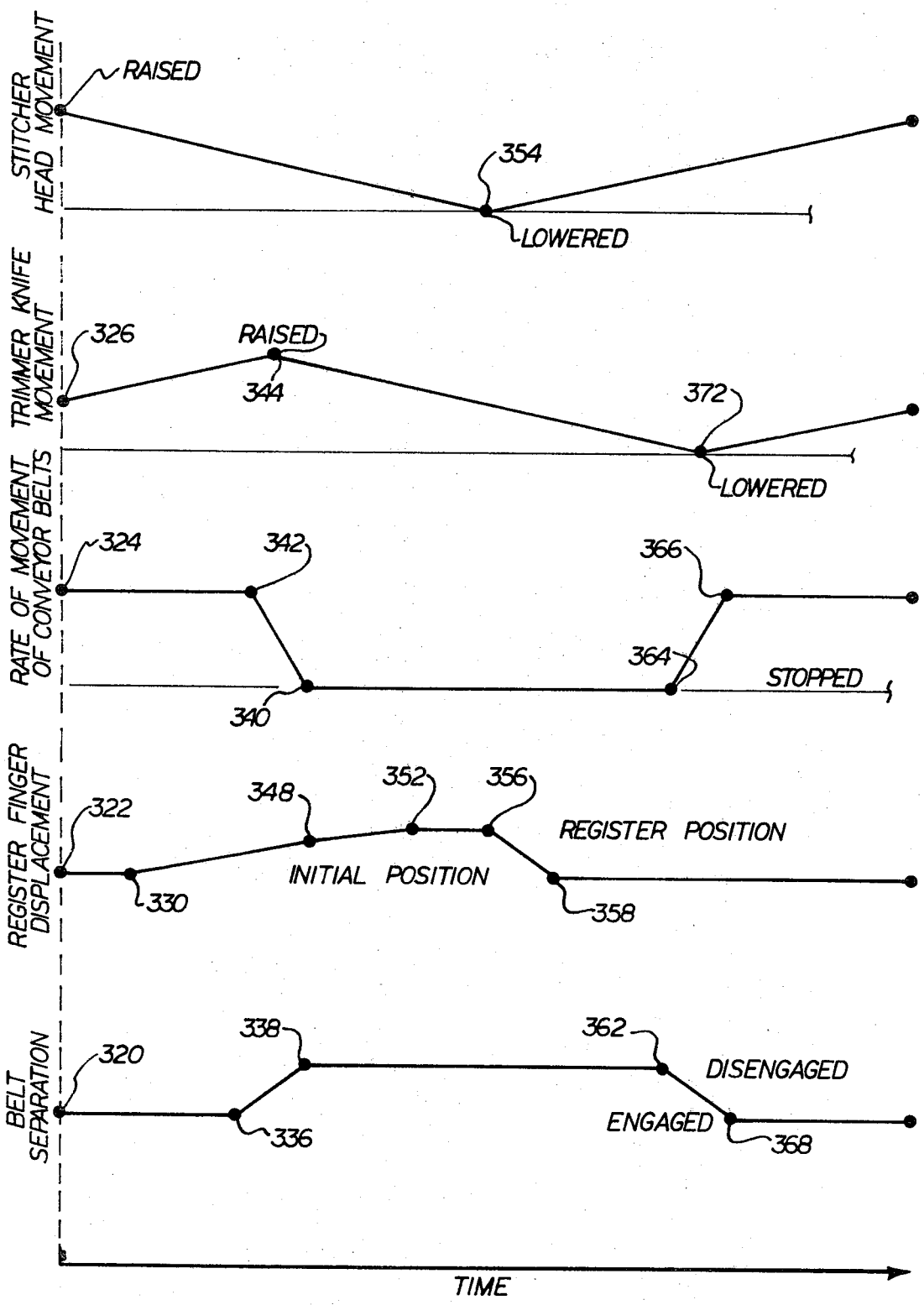
FIG. 8 is a timing diagram illustrating the sequential relationship between various functions performed by the machine of FIG. 1.

The relationship between different components of the machine 10 during an operating cycle of the machine is shown schematically in FIG. 8. The time chosen for the start of this cycle begins at the left in FIG. 8. At the chosen time for the start of the cycle, the conveyor belt assembly 20 is in the engaged condition indicated by the point 320 in FIG. 8. At this time, the register fingers 150 and 214 are in initial or start positions indicated by the point 322 in FIG. 8. The conveyor belts 40 and 70 and a gripped signature are being moved at a speed indicated at the point 324. A trimmer knife (not shown) is partially raised as indicated by the point 326. Finally, a stitcher head in the mechanism 14 is in a fully raised position.

As the operating cycle proceeds, the register fingers 150 and 214 start to move slowly forward, at the time indicated by the point 330 in FIG. 8. At this time, the conveyor belt assembly 20 is in the engaged condition and the signature is moving forward at a substantially higher speed.

As the register fingers continue to move forward, the conveyor belt assembly 20 is operated from the engaged condition to the disengaged condition indicated by the points 336 and 338 in FIG. 8. As the conveyor belt assembly 20 is disengaged, the forward motion of the signature and conveyor belts 40 and 70 is interrupted as indicated at the points 340 and 342 in FIG. 8. At this time, the trimmer knife has moved to a fully raised position indicated by the point 344 and the stitcher head has started to be lowered.

After the conveyor belt assembly 20 has become fully disengaged, the register fingers 150 and 214 move into engagement with the trailing edge 166 of the signature 156 at the time indicated at 348 in FIG. 8. After the register fingers 150 and 214 have engaged the trailing edge 166 of the signature 156, the register fingers continue to move the signature forward at a reduced speed to a register position. The register fingers 150 and 214 reach the register position at the time indicated at 352 in FIG. 8. The register fingers 150 and 214 dwell at the register position while the stitcher mechanism 14 is actuated at the time indicated at 354 during operation of the stitcher mechanism and at the time indicated at 356 on the register finger displacement curve.

The register fingers 150 and 214 are then moved back, away from the trailing edge 166 of the signature, to their initial position. The register fingers 150 and 214 reach their initial position at the time indicated at 358 in FIG. 8. As the register fingers are retracted, the stitched signature dwells for a short period of time while the stitcher mechanism 14 is raised away from the signature.

Operation of the conveyor belt assembly 20 from the disengaged condition toward the engaged condition is then initiated at a point of time indicated at 362 in FIG. 8. As the conveyor belt assembly 20 is engaged, the conveyor belts 40 and 70 begin to move at the time indicated at 364 and 366. The conveyor belt assembly 20 becomes fully engaged is indicated at the time indicated at 368 in FIG. 8. As the conveyor belt assembly 20 is being engaged, the trimmer knife reaches the end of cutting stroke, at the time indicated at 372, and begins to move back upwardly toward a raised position. The stitched signature is then moved by the engaged conveyor belt assembly 20 into the folder and trimmer assembly as the next succeeding signature is moved to the stitching station 12.

Second Embodiment of Conveyor Belt Drive

Figure 9:
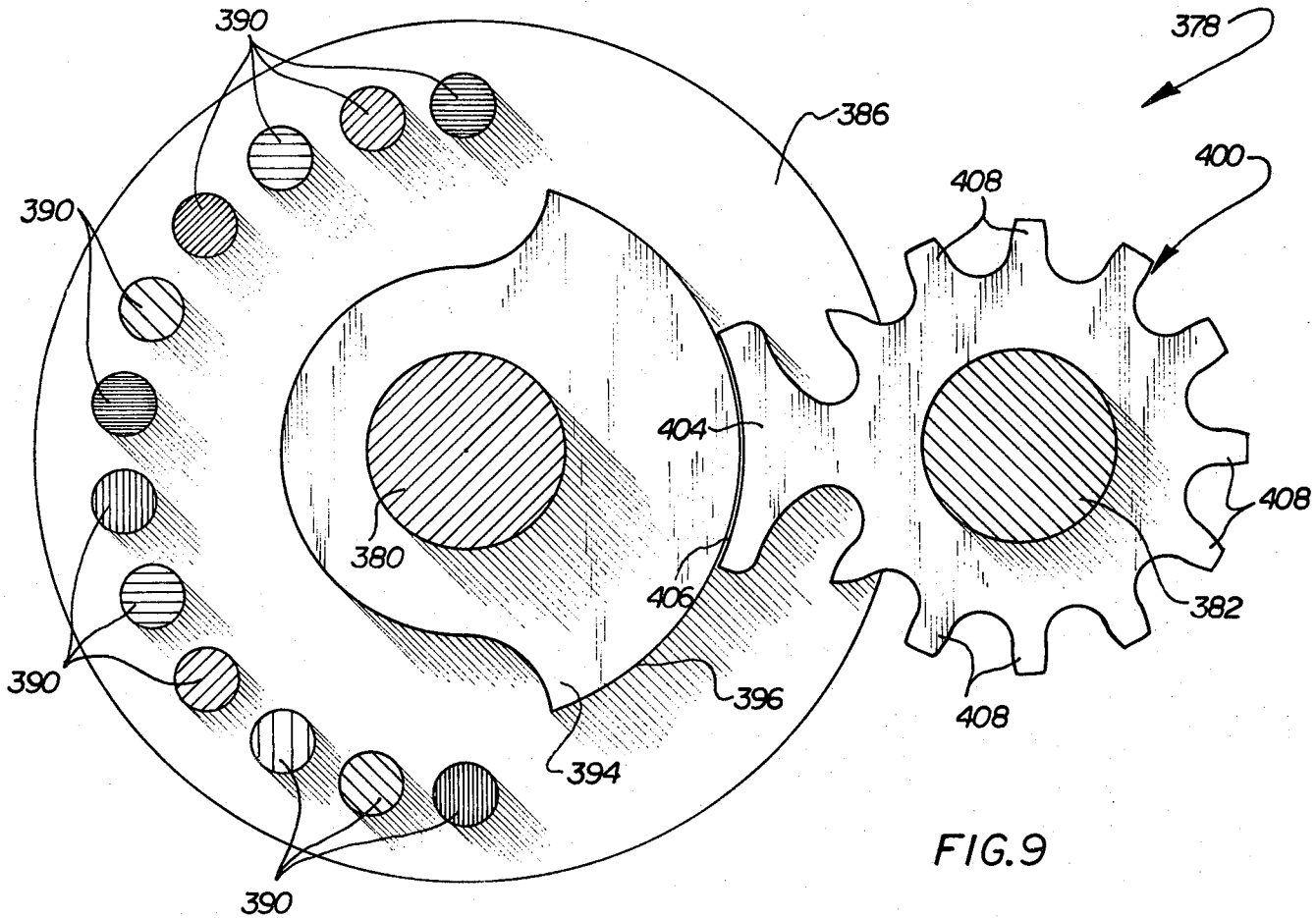
FIG. 9 is an illustration of driving and driven wheels of an intermittent drive mechanism of a second embodiment of the invention.

In the embodiment of the invention described in connection with FIGS. 1–8, the clutch assembly 226 is utilized to interrupt the drive to the upper and lower conveyor belt assemblies 34, 36. However, it is contemplated that additional time for acceleration and deceleration can be obtained by using an intermittent drive assembly 378 (FIG. 9) in place of the clutch 226. The intermittent drive assembly 378 includes an input shaft 380 (FIG. 9) which is driven at the same rotational speed as the shaft 202 (see FIG. 5). It is contemplated that this could be accomplished by either using a chain and sprocket drive or by using a one-to-one gear drive arrangement.

The intermittent drive assembly 378 has an output shaft 382 (see FIG. 9) which extends parallel to the input shaft 380 and the shaft 202 (see FIG. 5). The output shaft 382 from the intermittent drive assembly 378 is connected with the main drive pulley 230 (see FIG. 5). Thus, in the embodiment of the invention shown in FIG. 9, the main drive pulley 230 is connected to the output shaft 382 of the intermittent drive assembly rather than being connected to the drive shaft 122 as shown in FIG. 5. In addition in the embodiment of the invention shown in FIG. 9, the clutch assembly 226 is eliminated and the shaft 222 is not rotated. Thus, in this embodiment of the invention, the shaft 122 (FIG. 5) functions as a support shaft for the crank arm 120, drive forces being transmitted to the drive pulley 230 and the upper and lower conveyor belt assemblies 34 and 36 through the output shaft 382 (FIG. 9) of the intermittent drive assembly 378 and drive pulley 230 which is fixedly connected to the output shaft 382. It is contemplated that the intermittent drive assembly will be mounted to the left (as viewed in FIG. 5) of the drive shaft 122 and 202.

The intermittent drive assembly 378 is effective to rotate the output shaft 382 through one complete revolution each time the input shaft 380 is rotated through two complete revolutions. The intermittent drive assembly 378 includes a drive wheel 386 which is fixedly connected with the input shaft 380. The drive wheel 386 has a plurality of drive pins 390 which extend parallel to the shafts 380 and 382. The drive pins 390 are disposed in a semicircular array. The first and last pins 390 of the semicircular array are rotatably supported on the drive wheel 386. A retaining cam 394 is fixedly connected with the drive wheel 386 and has an arcuate cam surface 396 which extends through approximately 142° and is disposed in a coaxial relationship with the semicircular array of pins 390.

A star wheel 400 cooperates with the retaining cam 394 and pins 390 of the drive wheel 386 to rotate the drive shaft 382 through one complete revolution as the drive shaft 380 rotates through a first half of a revolution. During the rotation of the drive shaft 380 through the next half of the revolution, the star wheel 400 cooperates with the cam 394 to hold the drive shaft against rotational movement. The star wheel 400 and cam 394 cooperate so that the drive shaft is held against rotation for a full 180° of rotation in the input shaft 380. During the rotational movement of the star wheel 400 under the influence of drive forces transmitted through the pins 390, the star wheel accelerates during an initial portion of the rotational movement and decelerates during a final portion of the rotational movement.

The star wheel 400 includes a retaining section 404 having an arcuate end surface 406 which engages the outer side surface 396 of the cam 394. In addition, the star wheel 400 has a plurality of teeth 408 which engage the pin 390 to rotate the star wheel. Due to the interaction between the pins 390 and the teeth 408 of the star wheel, there is a relatively gradual acceleration and deceleration of the drive shaft 382. This results in the upper and lower conveyor belt assemblies 34 and 36 accelerating and decelerating a signature 156 over somewhat longer time periods than does the clutch 226.

Summary

The present invention provides a signature handling machine 10 which does not use a shuttle assembly to move a signature to and from a work station 12. In accordance with the present invention, a pair of belt assemblies 34 and 36 are used to transport the signature 156 to and from the stitching station 12. The direction of operation of the belt assemblies 34 and 36 is not reversed to eliminate the wasted effort and component wear associated with return strokes of shuttle assemblies.

During operation of a machine 10 constructed in accordance with the present invention, a signature 156 is gripped between upper and lower conveyor belts 40 and 70 and is moved to a stitching station 12. When the signature has been delivered to the stitching station 12, at least the central portions of the lower run 56 of the upper conveyor belt 40 and the upper run 68 of the lower conveyor belt 70 are separated and the signature is stitched. During the time when the signature is stitched, the conveyor belts 40 and 70 are stationary. Once the signature has been stitched, the conveyor belts 40 and 70 again grip the signature and move it away from the stitching station 12.

It is contemplated that the signature may not be precisely located at the stitching station 12 by the conveyor belts 40 and 70. Therefore, a register assembly 22 is advantageously provided to move the signature relative to the conveyor belts 40 and 70 after the signature has been moved to the stitching station and the conveyor belts have been separated. It is also contemplated that under certain circumstances it may be desirable to operate the machine 10 without stopping the signature at the stitching station. Therefore, the conveyor belt drive assembly 30 is operable either to intermittently drive the conveyor belts 40 and 70 or to continuously drive the conveyor belts to move signatures through the stitching station without stopping.

Having described specific preferred embodiments of the invention, the following is claimed:

1. An apparatus for moving a group of signatures to a work station, stitching the signatures at the work station, and moving the signatures away from the work station, said apparatus comprising upper and lower belt means for engaging opposite sides of a signature, said upper belt means having a lower run and said lower belt means having an upper run, said upper and lower belt means having inlet portions disposed on a first side of the work station, outlet portions disposed on a second side of the work station and central portions disposed between the inlet and outlet portions, belt drive means for driving said upper and lower belt means to move the signatures from the first side of the work station to the second side of the work station, actuator means for separating the central portions of the lower run of said upper belt means and the upper run of said lower belt means when the signature arrives at the working station, stitcher means at the work station for stitching the group of signatures while the central portions of the lower run of said upper belt means and the upper run of said lower belt means are separated, register means at the work station for moving the signatures relative to said upper and lower belt means to a predetermined position relative to said stitcher means while the central portions of the lower run of said upper belt means and the upper run of said lower belt means are separated, and control means for controlling the operation of said upper and lower belt means, actuator means, and stitcher means, said control means including means for interrupting operation of said belt drive means to maintain said upper and lower belt means stationary during stitching of the group of signatures by said stitcher means.

2. An apparatus as set forth in claim 1 wherein said upper belt means includes a first pulley disposed on the first side of the work station and a second pulley disposed on the second side of the work station, said lower run of said upper belt means extending between said first and second pulleys, said actuator means including means for moving said first and second pulleys away from said lower belt means to separate the central portions of the lower run of said upper belt means and the upper run of said lower belt means.

3. An apparatus as set forth in claim 1 wherein said register means includes register surface means for engaging a trailing edge portion of a signature when the central portions of the lower run of said upper belt means and the upper run of said lower belt means are separated and drive means for moving said register surface means and the signature along the lower run of said upper belt means and the upper run of said lower belt means while their central portions are separated.

4. An apparatus for moving a group of signatures to a work station, stitching the signatures at the work station, and moving the signatures away from the work station, said apparatus comprising upper and lower belt means for engaging opposite sides of the group of signatures, said upper belt means having a lower run and said lower belt means having an upper run, said upper and lower belt means having inlet portions disposed on a first side of the work station, outlet portions disposed on a second side of the work station and central portions disposed between the inlet and outlet portions, belt drive means for driving said upper and lower belt means to move signatures from the first side of the work station to the second side of the work station, actuator means for separating the central portions of the lower run of said upper belt means and the upper run of said lower belt means, stitcher means at the work station for stitching the group of signatures while the central portions of the lower run of said upper belt means and the upper run of said lower belt means are separated, register means at the work station for moving the group of signatures relative to said upper and lower belt means to a predetermined position relative to said stitcher means while the central portions of the lower run of said upper belt means and the upper run of said lower belt means are separated, and control means for controlling the operation of said upper and lower belt means, actuator means, and stitcher means, said control means including means for interrupting operation of said belt drive means to maintain said upper and lower belt means stationary during stitching of the group of signatures by said stitcher means, said lower belt means including a flexible continuous lower belt and a first rotatable pulley around which said lower belt extends, said upper belt means including a flexible upper belt and a second rotatable pulley around which said upper belt extends, said belt drive means including a first gear mounted in a coaxial relationship with said first pulley for rotation therewith and a second gear disposed in meshing engagement with said first gear and mounted in a coaxial relationship with said second pulley for rotation therewith, said actuator means including means for moving said second gear and said second pulley along an arcuate path having its center disposed on the axis of rotation of said first pulley and said first gear.

* * * * *